US008695851B2

(12) United States Patent
Pritchard

(10) Patent No.: US 8,695,851 B2
(45) Date of Patent: Apr. 15, 2014

(54) EXTERNAL FITMENT WITH ANTI-FLOW BLOCKING FEATURE FOR ASEPTIC PACKAGE AND METHOD OF USE

(75) Inventor: Barry Pritchard, Nazareth, PA (US)

(73) Assignee: Fres-co System USA, Inc., Telford, PA (US)

( * ) Notice: Subject to any disclaimer, the term of this patent is extended or adjusted under 35 U.S.C. 154(b) by 145 days.

(21) Appl. No.: 13/231,294

(22) Filed: Sep. 13, 2011

(65) Prior Publication Data

US 2012/0061394 A1 Mar. 15, 2012

Related U.S. Application Data

(60) Provisional application No. 61/383,041, filed on Sep. 15, 2010.

(51) Int. Cl.
*B67D 1/00* (2006.01)
*B65D 35/00* (2006.01)

(52) U.S. Cl.
USPC ..... 222/83; 222/90; 222/107

(58) Field of Classification Search
USPC ..... 222/107, 83, 90, 82, 105, 89, 92, 87
See application file for complete search history.

(56) References Cited

U.S. PATENT DOCUMENTS

| | | | | |
|---|---|---|---|---|
| 4,475,670 | A | | 10/1984 | Rutter |
| 4,603,793 | A | | 8/1986 | Stern |
| RE32,354 | E | | 2/1987 | Savage |
| 4,776,488 | A | | 10/1988 | Gurzan |
| 5,334,180 | A | * | 8/1994 | Adolf et al. ..... 604/411 |
| 5,407,099 | A | | 4/1995 | Heuke et al. |
| 6,082,584 | A | | 7/2000 | Stern |
| 6,098,845 | A | | 8/2000 | Stern |
| 6,227,410 | B1 | | 5/2001 | Stern |
| 6,354,473 | B1 | | 3/2002 | Brambach et al. |
| 6,460,732 | B1 | | 10/2002 | Drennow |

FOREIGN PATENT DOCUMENTS

| | | | |
|---|---|---|---|
| GB | 2136781 | A | 9/1984 |
| WO | 8503062 | A1 | 7/1985 |
| WO | 9727043 | A1 | 7/1997 |
| WO | 2009125032 | A1 | 10/2009 |

OTHER PUBLICATIONS

International Search Report for PCT/US2011/051538 mailed Dec. 16, 2011.

* cited by examiner

*Primary Examiner* — Kevin P Shaver
*Assistant Examiner* — Stephanie E Williams
(74) *Attorney, Agent, or Firm* — Caesar, Rivise, Bernstein, Cohen & Pokotilow, Ltd.

(57) ABSTRACT

A package, a fitment and method for dispensing a flowable material is disclosed. The package includes a hollow body formed of a flexible material and a fitment secured thereto. The fitment includes an outer gland and a plunger and overlies a frangible penetration zone in the hollow body of the package. The outer gland includes a passageway extending through it. The plunger has a cylindrical wall defining a hollow interior and a free end disposed within the passageway of the gland. The plunger is arranged to be moved along the passageway, so that its free end penetrates through the penetration zone into the interior of the package to provide an exit port for the material. The free end of the plunger also serves to hold portions of the walls of the package away from the exit port to prevent blockage thereof.

20 Claims, 2 Drawing Sheets

EXTERNAL FITMENT WITH ANTI-FLOW BLOCKING FEATURE FOR ASEPTIC PACKAGE AND METHOD OF USE

CROSS-REFERENCE TO RELATED APPLICATIONS

This application claims priority from Provisional Application Ser. No. 61/383,041, filed on Sep. 15, 2010, entitled External Fitment With Anti-Flow Blocking Feature For Aseptic Package and Method of Use, which application is assigned to the same assignee as this application and whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

This invention relates to valves and more particularly to flexible packages and more particularly to aseptic (sterile) flexible packages for dispensing flowable materials.

Several U.S. patents disclose flexible packages, i.e., packages including a flexible wall, adapted for holding a flowable, e.g., liquid or semi-liquid, product. Those packages include an inner coupling device that is located within the interior of the package adjacent an unopened portion of the package's flexible wall. An outer coupling device, typically in the form of a piercing device, is provided and arranged to be connected to the inner coupling device with a portion of the wall of the package interposed therebetween so that it can be pierced to provide access to the interior of the package. Examples of such patents are U.S. Pat. No: 4,603,793 (Stern); U.S. Pat. No. 4,776,488 (Gurzan); U.S. Pat. No. 5,407,099 (Heucke et al.); U. S. Pat. No. 6,082,584 (Stern); U.S. Pat. No. 6,098,845 (Stern); U.S. Pat. No. 6,227,410 (Stern); U.S. Pat. No. 6,460,732 (Drennow).

While the aforementioned devices may be generally suitable for their intended purposes they nevertheless leave something to be desired from one or more various standpoints of simplicity of construction, ease of use and resistance to blockage of flow. The subject invention addresses those needs.

SUMMARY OF THE INVENTION

One aspect of this invention entails a package for enabling the dispensing a flowable material therefrom. The package basically comprises a hollow body and a fitment. The hollow body includes a first wall portion and a second wall portion and a cavity located between said first and second wall portions for holding the flowable material therein. The wall portions are formed of a flexible material with the first wall portion having an exterior surface. The fitment includes an outer gland and a plunger. The outer gland comprises a flange fixedly secured to the exterior surface of the first wall portion and a passageway extending through the outer gland. The passageway overlies a frangible penetration zone of the first wall portion. The plunger comprises a cylindrical wall defining a hollow interior and a free end disposed within the passageway. The plunger is arranged to be moved longitudinally along the passageway, whereupon the free end of the plunger penetrates through the penetration zone to provide fluid communication between the cavity of the package and the interior of the plunger. The free end of the plunger is arranged to hold the second wall portion in a spaced relationship to the first wall portion after the penetration zone has been penetrated by the plunger.

Another aspect of this invention entails a fitment for securement to package for enabling the dispensing a flowable material therefrom. The, package comprises hollow body having of a first wall portion, a second wall portion and a cavity located between the first and second wall portions for holding the flowable material therein. The first wall portion includes a frangible penetration zone. The wall portions are formed of a flexible material, with the first wall portion having an exterior surface and a frangible penetration zone. The fitment comprises an outer gland and a plunge. The outer gland comprises a flange arranged to be fixedly secured to the exterior surface of the first wall portion and a passageway extending through the outer gland. The passageway overlies the penetration zone. The plunger comprises a cylindrical wall defining a hollow interior and a free end disposed within the passageway. The plunger is arranged to be moved longitudinally along the passageway, whereupon the free end of the plunger penetrates through the penetration zone to provide fluid communication between the cavity of the package and the interior of the plunger. The free end of the plunger is arranged to hold the second wall portion in a spaced relationship to the first wall portion after the penetration zone has been penetrated by the plunger.

In accordance with another aspect of this invention a method of dispensing a flowable material from a flexible package is provided. That method entails providing a dispensing package having features like those described above. The plunger is then moved longitudinally along the passageway to cause the free end of the plunger to penetrate through the penetration zone to provide fluid communication between the cavity of the package and the interior of the plunger and with free end of the plunger holding the second wall portion in a spaced relationship to the first wall portion after the penetration zone has been penetrated by the plunger.

DETAILED DESCRIPTION OF THE PREFERRED EMBODIMENT

Figure 1:
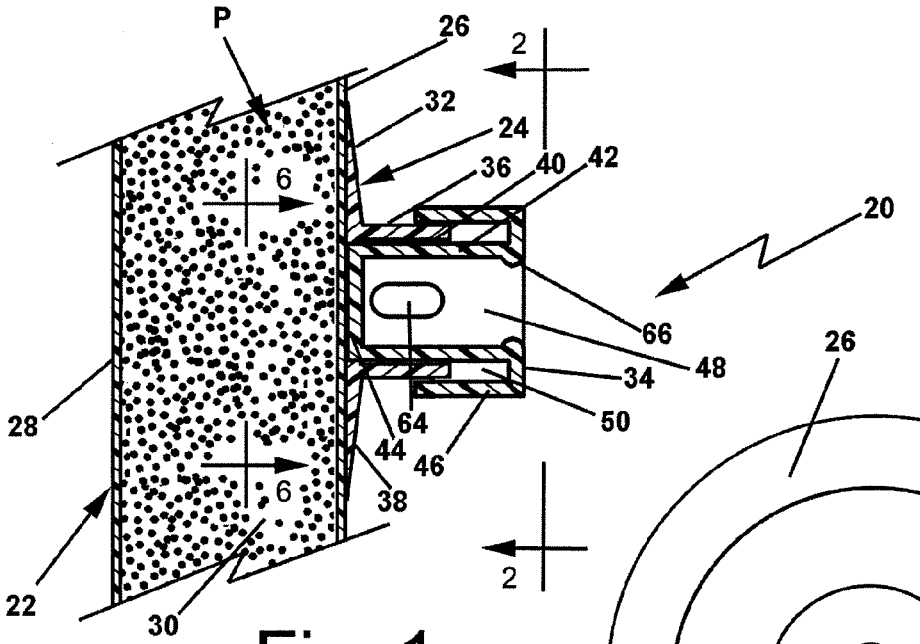
FIG. 1 is sectional side elevation view of a portion of a package including a fitment constructed in accordance with one exemplary embodiment of this invention.

Referring now to the various figures of the drawing wherein like reference characters refer to like parts, there is shown at 20 in FIG. 1 an exemplary embodiment of a flexible package including a body 22 and a fitment 24 constructed in accordance with this invention. This invention contemplates a variety of types of packages, e.g., "pillow" type pouches (rectangular or otherwise shaped), stand-up pouches (i.e., pouches having a bottom gusset to produce a self-standing geometry), parallelepiped (e.g., "brick-shaped") gusseted packages, U-shaped packages, etc. Irrespective of the shape of the package, the body 22 of each package comprises plural walls formed of a flexible sheet material. In the exemplary embodiment shown there are two walls, a front wall 26 and a rear wall 28. Those walls bound an interior cavity 30 in which a flowable material or product P is located. The packages of this invention are particularly suited for holding flowable foodstuffs, e.g., liquids, pasty materials, etc., or other products which need to be maintained under aseptic conditions until they are ready to be dispensed. To that end, the material (s) making up the package's walls can be either a single ply or multiple plies of any conventional flexible packaging material suitable for that purpose.

In accordance with one aspect of this invention a particular portion of a wall of the package is arranged to be penetrated by a plunger forming a portion of the fitment 24 to enable the contents of the package to be withdrawn, e.g., pumped out. That wall can be either wall 26 or 28, but in the embodiment shown is wall 26. The fitment 24 is constructed so that once the 26 wall of the package is penetrated by the plunger a portion of the plunger will be resident within the cavity 30 of package to ensure that the flow of product from the package isn't precluded by the collapsing walls of the package as it is emptied. The actual dispensing of the flowable product from the package is typically accomplished by use of a dispensing apparatus (only a portion of which is shown and which will be described later) into which the package is inserted.

Figure 2:
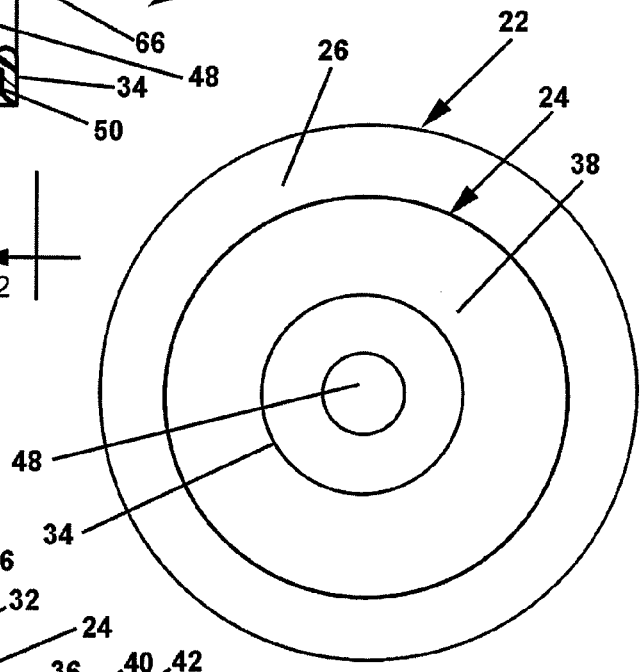
FIG. 2 is a plan view taken along line 2-2 of FIG. 1.
Figure 3:
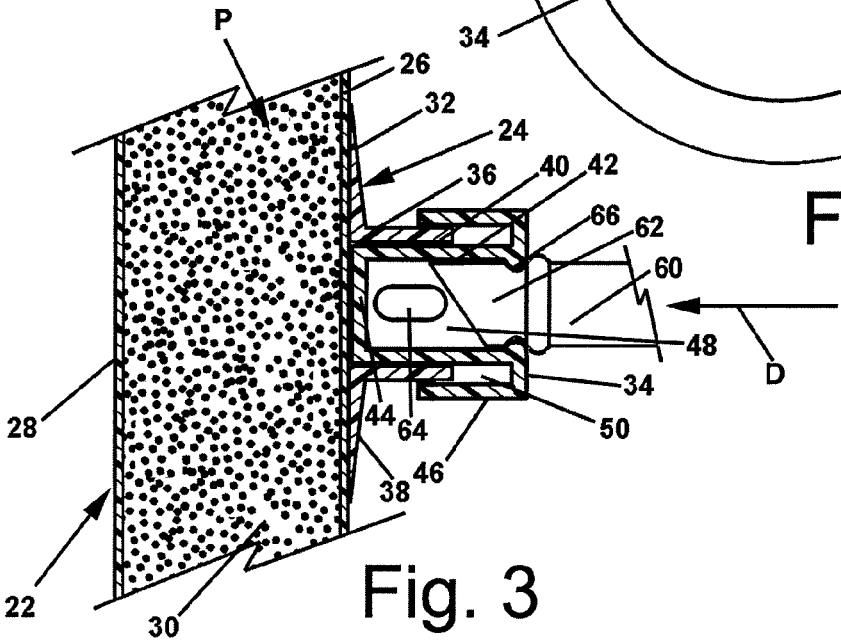
FIG. 3 is a sectional view, similar to FIG. 1, but showing an inlet tube to a pumping mechanism being connected to the fitment of the package.

Turning now to FIGS. 1-3 it can be seen that a portion of a wall 26 of the package 20 has an outer surface and an inner surface. The inner surface forms at least a portion of the boundary of the internal cavity 30. The fitment 24 is fixedly secured to the outer surface of the wall 26. The fitment 24 basically comprises an outer gland 32 and a plunger 34. The outer gland includes a central cylindrical wall portion 36 from which an annular flange 38 projects. The flange 38 includes a generally planar inner surface, which is fixedly secured, e.g., welded, to the outer surface of the package's wall 26. The cylindrical wall portion 36 of the gland includes a central passageway or throat 40 (FIG. 1) extending the entire length of the wall portion 36 from its free end to the inner surface of the flange 38.

The plunger 34 is in the form of a hollow cylindrical member having a circular sidewall 42, an end wall 44 and an annular collar 46. The hollow interior within the circular sidewall is designated by the reference number 48 (FIG. 1) and serves to receive a portion of a pump mechanism of the dispensing apparatus (as will be described later). The outer diameter of the circular sidewall 42 of the plunger 34 is just slightly less than the inner diameter of the throat 40 of the gland 30 so that the sidewall 42 can fit therein. The collar 46 is disclosed concentrically about the cylindrical sidewall 42 of the plunger 32 to form an annular recess 50. The annular recess 50 is arranged for receipt of the circular wall portion 42 of the outer gland 30 so that the plunger 34 can be moved (pushed) longitudinally through the throat 40 in a direction of the arrow D as shown in FIG. 3. The movement of the plunger in this direction effects the penetration of the wall 26 of the package.

Figure 6A:
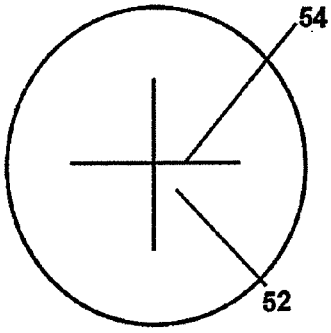
FIG. 6A is a plan view of one exemplary penetration zone portion of the wall of the package of FIG. 1 taken along line 6-6 of FIG. 1.
Figure 6B:
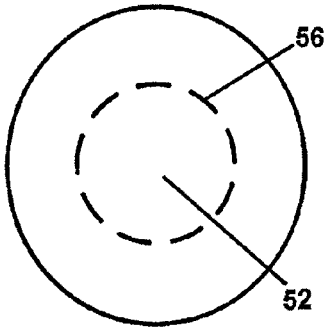
FIG. 6B is a plan view of another exemplary penetration zone portion of the wall of the package of FIG. 1 taken along line 6-6 of FIG. 1.
Figure 6C:
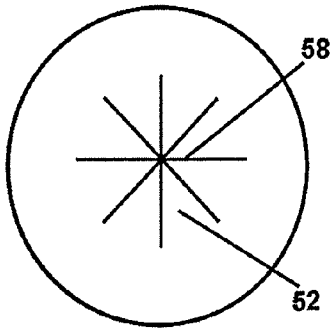
FIG. 6C is a plan view of still another exemplary penetration zone portion of the wall of the package of FIG. 1 taken along line 6-6 of FIG. 1.

To that end, the wall 26 of the package at the location of the fitment 24 is frangible, e.g., cut or otherwise weakened, across an area 52 (referred to hereinafter as the "penetration zone" which is shown in FIGS. 6A, 6B and 6C) to enable the plunger to readily pass therethrough when it is pushed in the direction of arrow D. The penetration zone 52 can take various forms. For example, the penetration zone 52 may be in the form of an X or cruciform cut 54 as shown in FIG. 6A or may be in the form of a circular perforated cut 56 as shown in FIG. 6B or may be in the form of a starburst shaped cut 58 as shown in FIG. 6C. In fact, it should be pointed out at this juncture that the penetration zone 52 can take other forms than the examples shown in FIGS. 6A-6C, so long as the penetration zone is arranged to be readily penetrated when the plunger is pushed in the direction of arrow D and providing that the flowable contents P of the package cannot flow through the penetration zone before the plunger penetrates the zone. Thus, irrespective of the construction of the package at the penetration zone, e.g., whether it is in the form of a cut, perforations or other weakened wall portion, the penetration zone should be of a size and shape so that it will be completely covered by the fitment 24 when the fitment is secured to the wall 26 of the package. That arrangement ensures that the securement of the fitment over the penetration zone effectively seals the zone from accidental leakage of the flowable material therethrough until the plunger is activated.

As mentioned earlier the package of this invention is arranged to be used with dispensing apparatus to dispense, e.g., pump, the flowable product from the package. The dispensing apparatus can take various forms, e.g., it can include a chamber (not shown) in which the package 20 will be disposed, and an associated pump mechanism (also not shown) to pump the flowable product from the package. The input to the pump mechanism is typically in the form of a tube 60 (FIGS. 3-5), which commonly includes a sharp piercing member or tip 62. In the prior art the piercing tip is used to pierce through the wall of a conventional flexible package containing the flowable product to be dispensed to provide access to that product. The package of this invention can be used with such conventional dispensing apparatus, but it doesn't need to make use of the pump mechanism's piercing tip 62 to effect the piercing of the wall of the package, since the plunger 34 of the fitment 24 accomplishes that action.

Thus, as best seen in FIGS. 2-5 the hollow interior 48 of the plunger 34 is arranged to receive the tip 62 of the inlet tube 60 of the dispensing apparatus' pump mechanism. The sidewall 42 of the plunger 34 includes a plurality of openings 64, e.g., slots, disposed at equidistantly spaced locations about the periphery of the sidewall adjacent the plunger's end wall 44. It is through these openings that the flowable material P passes from the interior cavity 30 of the package into the hollow interior of the plunger 34 and from there into the inlet tube 60 when the pump mechanism of the dispensing apparatus is actuated.

The use of package 20 to dispense, e.g., pump, the flowable material P therefrom is accomplished as follows. A filled package 20 is oriented so that the fitment 24 is readily accessible, such as shown in FIG. 1. The piercing tip 62 of an inlet tube 60 of the pump mechanism of the dispensing apparatus is inserted into the hollow interior 48 of the plunger to releasably secure the tube (and the associated pump mechanism) to the plunger. In order to keep the piercing tip 62 from blocking the slots 64 of the plunger 34 and to enable the inlet tube 60 to be releasably secured to the fitment 24 the inner surface of the plunger at the entrance to the interior 48 preferably includes an annular ridge 66 for releasably accommodating (e.g., snap-fitting) a correspondingly shaped annular recess that extends about the periphery of the inlet tube adjacent its tip 62. That annular recess is located at a position so that when the annular ridge 66 of the plunger is snap-fit within it, the open free end of the inlet tube tip 62 is spaced slightly from the end wall 44 of the plunger, whereupon the slots 64 in the plunger 34 are in fluid communication with the interior passageway extending through the inlet tube 60. Moreover, the snap-fit connection between the inlet tube 60 and the plunger 34 forms a fluid-tight seal at their interface so that none of the flowable material P can accidentally exit, e.g., seep out, through that interface.

Figure 4:
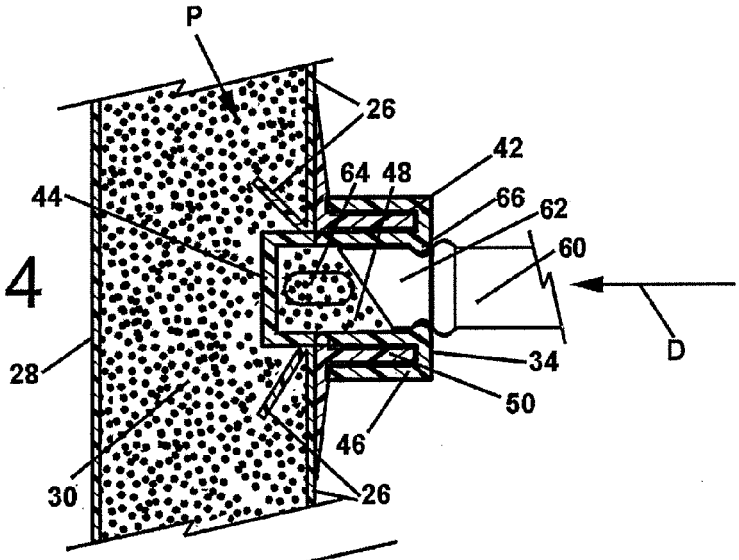
FIG. 4 is a sectional view, similar to FIG. 3, but showing fitment in use for penetrating a wall of the package to provide access to the contents within the interior of the package.
Figure 5:
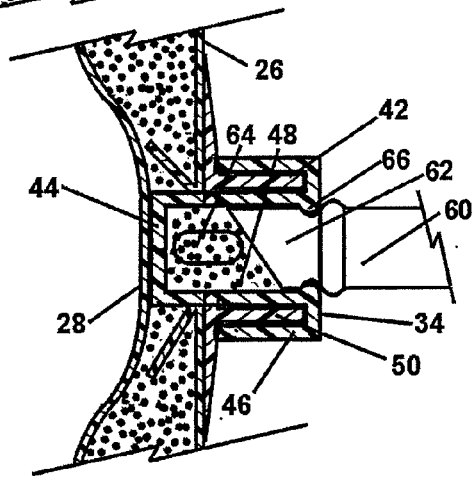
FIG. 5 is a sectional view, similar to FIG. 4, but showing how the fitment of this invention prevents blockage of the outlet port created by the fitment upon evacuation of the contents of the package through the fitment.

Once the inlet tube 60 is connected to the plunger 34 as just described, the plunger may be pushed inward in the direction of arrow D as shown in FIGS. 3 and 4, whereupon the free end wall 44 of the plunger 34 engages the underlying frangible penetration zone 52. This action causes the wall 26 of the package's body at the penetration zone 52 to burst open as shown in FIG. 4, whereupon the free end of the plunger 34 enters into the cavity 24 where the flowable product resides to create an exit port for that product. The product can then be pumped out of the package by use of the pumping mechanism of the dispensing apparatus (not shown). In particular, when that pumping mechanism is operated, it draws the flowable product from the package's interior cavity 30 through the now opened penetration zone, through the slots 66 of the plunger 34 into the interior 48 of the plunger, from whence it passes into the open end of the inlet tube for dispensing by the dispensing apparatus. As will be appreciated by those skilled in the art the pumping action will have the automatic effect of drawing down the contents of the package 20, thereby causing the package's walls 26 and 28 to collapse toward each other, like shown in FIG. 5. Such action, could have the effect of interrupting the flow of the product out of the package if any portion of the collapsing wall of the package moved into engagement to block the exit port. However, the construction of the fitment 34 prevents the wall 28 from blocking the exit port in wall 26. In particular, when the end wall 44 of the plunger is located within the package's cavity 24, it serves to hold any portion of the opposite wall 28 in a spaced relationship away from the wall 26, thereby ensuring that the flow of the product out of the package is not blocked or interrupted by the portion of wall 28.

As should be appreciated by those skilled in the art, the package of this invention is simple in construction, is easy to use and enables the reliable pumping of the flowable material from it without interference from any portion of the wall of the package as the package is emptied. The construction of the fitment and the package can be varied from that shown and described above. Thus, the fitment 24 is merely exemplary of any number of fitments that can be constructed in accordance with this invention. For example, the shape of end wall 44 (the portion of the plunger that engages the wall of the package at the penetration zone) can be different than the planar wall shown. The manner of releasably coupling the inlet tube to a pump mechanism can be different, e.g., the cooperating ridge and groove, may be replaced with a frictional fitting. In fact, the package of this invention need not be used with a pumping mechanism, e.g., it may be used with a tube for allowing the contents of the package to flow out of the package under the influence of gravity, depending upon the application for the package and the product held within the package. Moreover, while the package has been shown as being aseptic, it need not be so constructed. Further still, the construction and arrangement of the penetration zone can be other than that shown and described above.

Without further elaboration the foregoing will so fully illustrate my invention that others may, by applying current or future knowledge, adopt the same for use under various conditions of service.

I claim:

1. A package including a fitment which when operated enables the dispensing of a flowable material from said package, said package comprising a hollow body and said fitment, said hollow body comprising of a first wall portion and a second wall portion and a cavity located between said first and second wall portions for holding the flowable material therein, said wall portions being formed of a flexible material, with said first wall portion having an exterior surface and a frangible penetration zone, said fitment being located on said exterior surface with no portion of said fitment being located within said cavity, whereupon said frangible penetration zone of said first wall portion is able to be engaged by said second wall portion without interference of any portion of said fitment, said fitment comprising an outer gland and a plunger, said outer gland comprising a flange fixedly secured to said exterior surface of said first wall portion and a passageway extending through said outer gland, said passageway overlying said penetration zone, said plunger comprising a cylindrical wall defining a hollow interior and a free end disposed within said passageway, said plunger being arranged to be moved longitudinally along said passageway relative to said flange when said fitment is operated, whereupon said free end of said plunger moves with respect to said flange and penetrates through said penetration zone to enter said cavity to provide fluid communication between said cavity and said interior of said plunger, said free end of said plunger being arranged to directly engage said second wall portion to hold said second wall portion in a spaced relationship to said first wall portion at said penetration zone after said penetration zone has been penetrated by said plunger and said free end of said plunger has entered said cavity.

2. The package of claim 1 wherein said penetration zone comprises at least one cut or perforation.

3. The package of claim 1 wherein said hollow interior of said plunger is arranged to releasably receive a tube of an associated dispensing device.

4. The package of claim 1 wherein said plunger includes at least one opening adjacent said free end into which said flowable material can flow.

5. The package of claim 4 wherein said free end of said plunger comprises a generally planar end wall.

6. The package of claim 5 wherein said cylindrical sidewall of said plunger includes said at least one opening.

7. The package of claim 1 wherein said outer gland comprises a cylindrical side wall, said cylindrical side wall forming said passageway.

8. The package of claim 7 wherein said plunger additionally comprises a collar arranged to extend about said cylindrical side wall.

9. The package of claim 8 wherein said hollow interior of said plunger is arranged to releasably receive a tube of an associated dispensing device.

10. A fitment for securement to package for enabling the dispensing a flowable material therefrom when said fitment is operated, the package comprising hollow body having a first wall portion, a second wall portion and a cavity located between the first and second wall portions for holding the flowable material therein, the wall portions being formed of a flexible material, with the first wall portion having an exterior surface and a frangible penetration zone, said fitment being located on the exterior surface with no portion of said fitment being located within the cavity, whereupon the frangible penetration zone of the first wall portion is able to be engaged by the second wall portion without interference of any portion of said fitment, said fitment comprising an outer gland and a plunger, said outer gland comprising a flange arranged to be fixedly secured to the exterior surface of the first wall portion and a passageway extending through said outer gland, said passageway overlying the penetration zone, said plunger comprising a cylindrical wall defining a hollow interior and a free end disposed within said passageway, said plunger being arranged to be moved longitudinally along said passageway relative to said flange when said fitment is operated, whereupon said free end of said plunger moves with respect to said flange and penetrates through the penetration zone to provide fluid communication between the cavity and said interior of said plunger, said free end of said plunger being arranged to directly engage the second wall portion to hold the second wall portion in a spaced relationship to the first wall portion at said penetration zone after the penetration zone has been penetrated by said plunger and said free end of said plunger has entered the cavity.

11. The fitment of claim 10 wherein said hollow interior of said plunger is arranged to releasably receive a tube of an associated dispensing device.

12. The fitment of claim 10 wherein said plunger includes at least one opening adjacent said free end into which said flowable material can flow.

13. The fitment of claim 12 wherein said free end of said plunger comprises a generally planar end wall.

14. The fitment of claim 13 wherein said cylindrical sidewall of said plunger includes said at least one opening.

15. The fitment of claim 10 wherein said outer gland comprises a cylindrical side, said cylindrical side wall forming said passageway.

16. The fitment of claim 15 wherein said plunger additionally comprises a collar arranged to extend about said cylindrical side wall.

17. The fitment of claim 16 wherein said hollow interior of said plunger is arranged to releasably receive a tube of an associated dispensing device.

18. A method for dispensing a flowable material from a flexible package by operation of a fitment, said method comprising:

providing a flexible package comprising a hollow body and said fitment, said hollow body comprising of a first wall portion and a second wall portion and a cavity located between said first and second wall portions for holding the flowable material therein, said wall portions being formed of a flexible material, with said first wall portion having an exterior surface, and a frangible penetration zone, said fitment being located on said exterior surface with no portion of said fitment being located within said cavity, whereupon said frangible penetration zone of said first wall portion is able to be engaged by said second wall portion without interference of any portion of said fitment, said fitment comprising an outer gland and a plunger, said outer gland comprising a flange fixedly secured to said exterior surface of said first wall portion and a passageway extending through said outer gland, said passageway overlying said frangible penetration zone of said first wall portion, said plunger comprising a cylindrical wall defining a hollow interior and a free end disposed within said passageway; and operating said fitment to move said plunger longitudinally along said passageway relative to said flange to cause said free end of said plunger to penetrate through said penetration zone to enter said cavity to provide fluid communication between said cavity and said interior of said plunger and with free end of said plunger directly engaging said second wall portion to hold said second wall portion in a spaced relationship to said first wall portion at said penetration zone after said penetration zone has been penetrated by said plunger and said free end of said plunger has entered said cavity.

19. The method of claim 18 additionally comprising connecting a tube of a dispensing apparatus to said plunger to cause said flowable material to flow into said tube.

20. The method of claim 19 wherein said flowable material is pumped into said tube.

* * * * *